US005799528A

United States Patent [19]

Camping

[11] Patent Number: 5,799,528

[45] Date of Patent: Sep. 1, 1998

[54] MANUALLY OPERATED TOOL FOR UPSETTING A STEEL REINFORCEMENT BAR

[75] Inventor: Michael J. Camping, Cumbia, England

[73] Assignee: Headed Reinforcement Corporation, Fountain Valley, Calif.

[21] Appl. No.: 733,511

[22] Filed: Oct. 18, 1996

[51] Int. Cl.[6] ..... B21J 7/18

[52] U.S. Cl. ..... 72/318; 72/354.2; 72/377; 72/453.16

[58] Field of Search ..... 72/318, 316, 322, 72/315, 377, 357, 361, 354.2, 453.15, 453.16

[56] References Cited

U.S. PATENT DOCUMENTS

| | | | |
|---|---|---|---|
| 1,983,618 | 12/1934 | Lamond | 72/357 |
| 2,766,631 | 10/1956 | Van Sittert | 72/453.16 |
| 5,119,667 | 6/1992 | Hollis | 72/453.16 |
| 5,134,872 | 8/1992 | Ose | 72/318 |

FOREIGN PATENT DOCUMENTS

| | | | |
|---|---|---|---|
| 1295503 | 5/1952 | France | 72/354.2 |
| 104234 | 6/1984 | Japan | 72/318 |
| 104235 | 6/1984 | Japan | 72/316 |
| 1232193 | 7/1987 | U.S.S.R. | 72/354.2 |

*Primary Examiner*—Daniel C. Crane
*Attorney, Agent, or Firm*—Morland C. Fischer

[57] ABSTRACT

A portable tool for mechanically upsetting a steel reinforcement bar (e.g. rebar), one end of which is typically embedded in a concrete or similar structure, so that a relatively wide upset head can be formed at the protruding end to permit the bar to be reliably coupled to an opposing reinforcement bar. The protruding end of the reinforcement bar is first pre-heated and then inserted within the upsetting tool. A plurality of rotatable jaws are first moved towards and then rotated into clamping engagement against the reinforcement bar. A supply of hydraulic fluid is added to a cylinder of the tool for causing a hydraulic piston to be moved in a first direction through the cylinder to simultaneously compress a normally relaxed spring and drive an upsetting block towards and into engagement with the pre-heated end of the reinforcement bar so as to compress the pre-heated end between the jaws and the upsetting block in order to form the upset head. The hydraulic fluid is then removed from the cylinder whereby the previously compressed spring expands to simultaneously drive the hydraulic piston in an opposite direction through the cylinder and pull the upsetting block away from the upset head. The jaws are then rotated out of clamping engagement with and moved away from the upset reinforcement bar so as to permit the bar to be removed from the tool.

12 Claims, 4 Drawing Sheets

Fig. 1
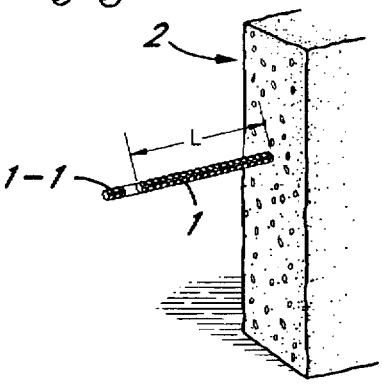
Fig. 2
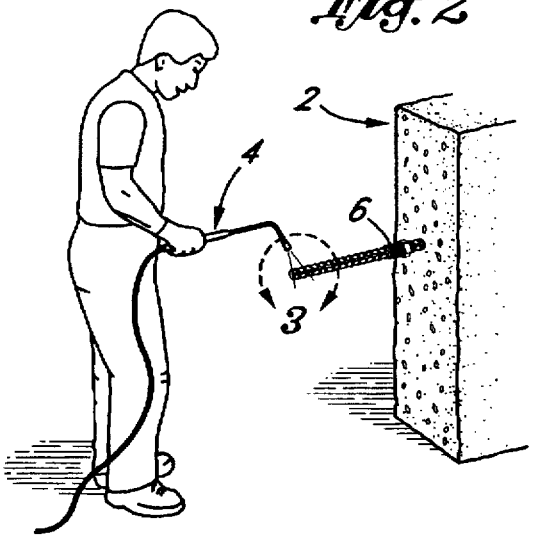
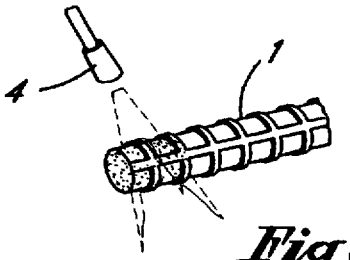
Fig. 3
Fig. 4
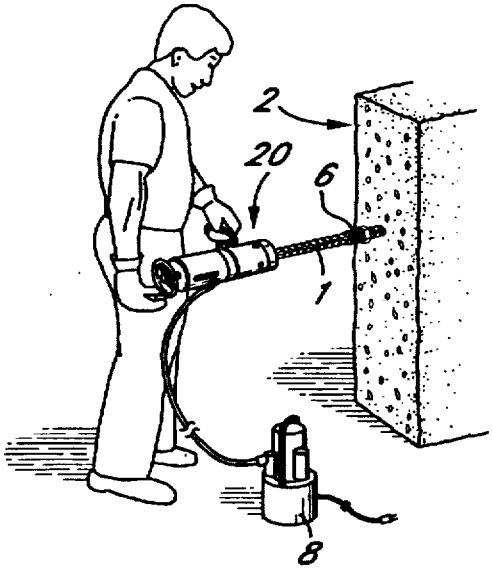
Fig. 5
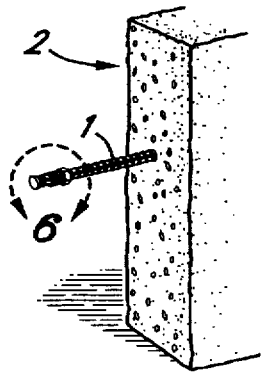
Fig. 6
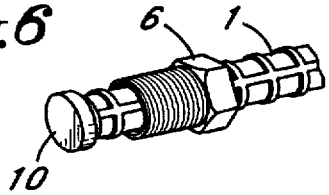

MANUALLY OPERATED TOOL FOR UPSETTING A STEEL REINFORCEMENT BAR

BACKGROUND OF THE INVENTION

1. Field of the Invention

This invention relates to a portable tool that can be advantageously carried to and manually operated in the field to upset the pre-heated end of a steel reinforcement bar (e.g. rebar), the opposite end of which is typically embedded in a concrete or similar structure, so that the upset end of the bar can be reliably coupled to an opposing reinforcement bar.

2. Background Art

U.S. patent application Ser. No. 08/570,099 filed Dec. 11, 1995 describes a method and a coupling assembly by which to permit a short upstand of steel reinforcement bar (i.e. sometimes known as rebar) that protrudes from an existing concrete structure to be extended at a retrofit work site in the field so as to provide a continuous connection between the existing structure and an adjacent new structure. By way of example, the foregoing enables a new concrete structure to be added to an existing concrete structure so as to prevent the new and existing structures from shifting relative to one another.

The method described in U.S. patent application Ser. No. 08/570,099 includes the step of forming a relatively large upset head at the protruding end of the reinforcement bar. More particularly, a split forming die is clamped to the upstand and the protruding end thereof is upset by first heating the end and then deforming the end into the shape of the die by means of an electric hammer or hydraulic jack.

However, the aforementioned method of upsetting the reinforcement bar sometimes requires that two workmen be present. Similarly, a certain amount of skill and judgement is required when using an impact tool to mechanically deform the heated end of the reinforcement bar. That is to say, the resulting upset heads formed on different bars usually have different sizes and shapes. In some cases, the upset head is not large enough to be reliably coupled to an opposing reinforcement bar. In other cases, those in the construction industry cannot be certain that the coupled connection of opposing reinforcement bars that extend between existing and new structures will accurately break at the full load capacity of the bars.

U.S. patent application Ser. No. 08/668,127 filed Jun. 21, 1996 describes a hydraulically operated tool for upsetting a steel reinforcement bar which overcomes the aforementioned disadvantages of using a split forming die and an electric hammer or hydraulic jack. This tool is relatively compact and portable and is especially suited for producing upset heads of uniform size and shape where a large number of reinforcement bars are to be coupled together in the field. However, to minimize the cost of manufacture and the complexity associated with such a hydraulically operated upsetting tool, what is also needed is a lower cost, relatively simple to use, manually operated upsetting tool having particular application when it is necessary to upset only a few reinforcement bars but which retains the benefits of the hydraulically operated tool disclosed in patent application Ser. No. 08/668,127.

SUMMARY OF THE INVENTION

The upsetting tool of the present invention includes the interconnection of a mouth having a sloping inlet opening, a hollow collar, and a housing. In the assembled relationship, the housing is surrounded by and adapted to slide through the hollow collar. The housing has a plurality of rotatable jaws at the front end thereof which are adapted to pivot towards each other and into clamping engagement with the protruding end of a reinforcement bar which is first pre-heated to a temperature of about 1100° C. Each of the jaws has a pair of chamfers extending axially therealong to define the shape of the upset head to be formed. At the rear end of the housing is a cylinder. A fluid hose is connected at one end thereof to a source of hydraulic fluid (e.g. oil) and at the opposite end to the cylinder of the housing. A hydraulic piston is located in the cylinder of the housing and adapted to move therethrough, against the bias of a normally relaxed compression spring, towards the reinforcement bar to be upset. An upsetting anvil, which is connected to the hydraulic piston by way of a piston rod, is disposed outside the cylinder in axial alignment with the pre-heated end of the reinforcement bar, such that a movement of the hydraulic piston through the cylinder is transferred to the upsetting anvil.

The upsetting tool also includes a piston assembly having a piston head that is affixed to the rear end of the cylinder of the housing. A threaded rod extends from the piston head, through a threaded opening at the rear end of the hollow collar, to a control wheel. A rotation of the control wheel by the tool operator is translated into an axial displacement of the piston head so as to cause the housing to which the piston head is affixed to move through the collar.

In operation, the upsetting tool is carried into position to receive the pre-heated end of the reinforcement bar through the mouth thereof. The operator of the tool then rotates the control wheel of the piston assembly in a clockwise direction to move the piston head in a forward direction towards the reinforcement bar to be upset. A forward movement of the piston head pushes the housing through the collar so that the jaws of the housing are moved up the sloping inlet opening of the mouth and thereby rotated into clamping engagement against the reinforcement bar. Next, hydraulic fluid is supplied from the fluid source to fill the cylinder of the housing via the fluid hose. The hydraulic pressure in the cylinder increases so as to cause the hydraulic piston to move in the forward direction through the cylinder of the housing and towards the immoveable reinforcement bar, whereby the normally relaxed compression spring is compressed. The forward movement of the hydraulic piston is imparted to the upsetting anvil through the piston rod which is connected therebetween, such that the upsetting anvil correspondingly moves towards and compresses the pre-heated end of the reinforcement bar in order to cause an upset head to be shaped within the chamfers of the clamping jaws.

After the upset head is formed, hydraulic fluid is no longer supplied to the cylinder of the housing. At this time, the compression spring expands towards its normally relaxed condition and potential energy that has been stored within the spring is released to drive the hydraulic piston in an opposite, rearward direction through the cylinder away from the reinforcement bar. Accordingly, the hydraulic fluid is expulsed from the cylinder and returned to the fluid source via the fluid hose. The rearward movement of the hydraulic piston also causes a corresponding movement of the upsetting anvil away from the newly formed upset head. The tool operator now rotates the control wheel of the piston assembly in a counter-clockwise direction to move the piston head and the housing that is affixed thereto rearwardly through the collar and away from the upset reinforcement bar so that the jaws of the housing release their clamping engagement against the bar. The tool can be withdrawn from the reinforcement bar and carried to another reinforcement bar in the field in order to be used in an identical manner to that described above.

BRIEF DESCRIPTION OF THE DRAWINGS

FIGS. 1–6 illustrate the method by which the portable, manually operated upsetting tool of this invention is used in the field to form an upset head at the pre-heated end of a steel reinforcement bar that protrudes from a concrete or similar structure;

DETAILED DESCRIPTION

Figure 7:
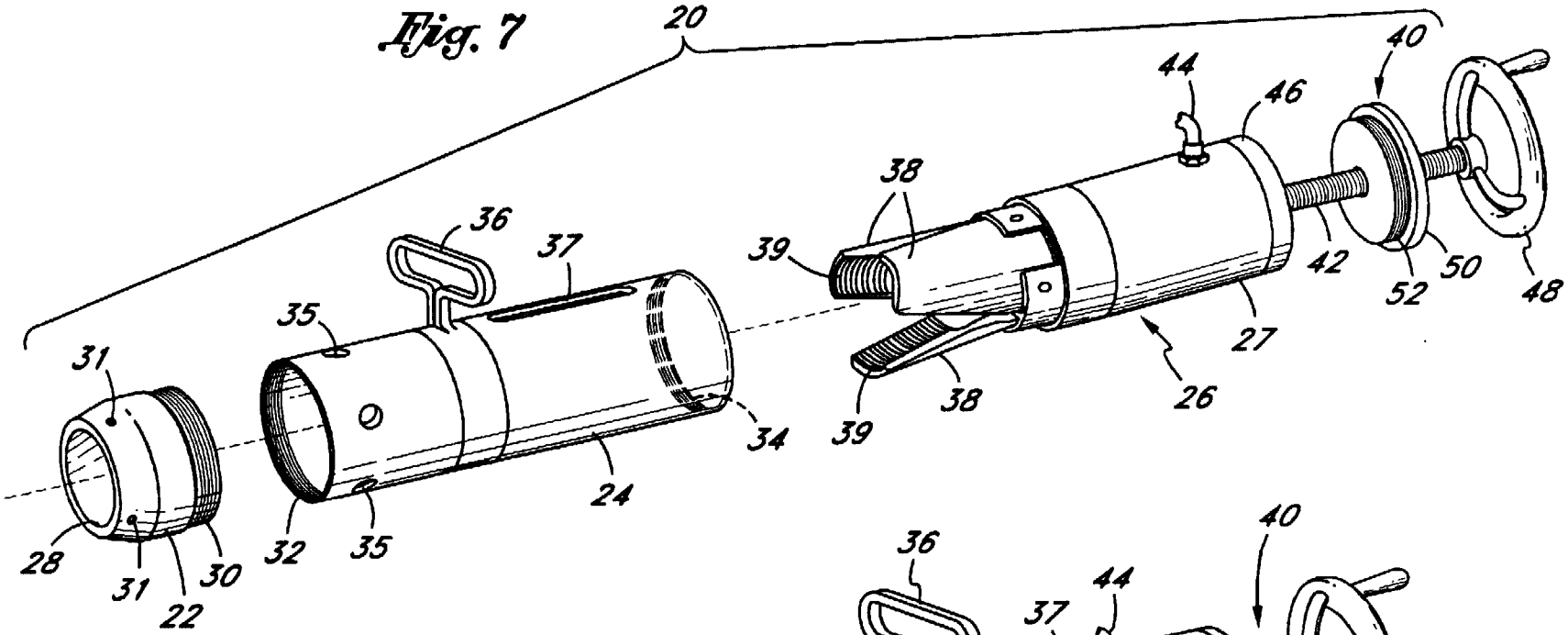
FIG. 7 is an exploded view of the upsetting tool used to upset the reinforcement bar in FIGS. 1–6.

The portable, manually operated tool 20 for upsetting a steel reinforcement bar (e.g. rebar) is now described in detail while referring to the drawings. FIGS. 1–6 illustrate the steps for using the tool 20 in the field to upset the protruding end of a relatively short upstand from a reinforcement bar 1 that is embedded in and projects from a concrete or similar structure 2. Initially, the reinforcement bar 1 is shortened to a length that is suitable to receive the soon-to-be described upsetting tool 20. As one advantage of using upsetting tool 20, the length of reinforcement bar 1 (designated L in FIG. 1) may be as little as four inches. For longer bars, any suitable excess portion (designated 1—1 in FIG. 1) is removed by means of a conventional heating/cutting torch (designated 4 in FIG. 2) such as an oxy/fuel, resistance or induction heating torch.

Next, and as is best shown in FIG. 2, a threaded coupling nut 6 is placed over and moved along the reinforcement bar 1. The coupling nut 6 may be identical to that described in U.S. patent application Ser. No. 08/570,099 which is incorporated herein by reference and which has been or will be assigned to the assignee of this application. Therefore, coupling nut 6 will not be described again. Referring to FIGS. 2 and 3, with the coupling nut 6 moved away from the protruding end of bar 1, the aforementioned heating/cutting torch 4 is used to heat a length of the protruding end of reinforcement bar 1 that is about twice the diameter of the bar. It is preferable to heat the protruding end that is to be upset for at least one minute at a temperature of approximately 1100 degrees C.

FIG. 4. shows the manually operated upsetting tool 20 being used by a workman to upset the pre-heated protruding end of reinforcement bar 1 so as to form a relatively wide upset head (designated 10 in FIG. 6) that is about 20 to 25% larger in cross-sectional area than the cross-sectional area of the bar 1 before it was upset. More particularly, the upsetting tool 20 applies hydraulic pressure between 3,000 to 7,000 psi to the pre-heated end of reinforcement bar 1 until the upset head 10 is formed. However, it is to be understood that the precise size of the upset head 10 of steel reinforcement bar 1 is not to be considered a limitation of the present invention.

FIGS. 5 and 6 show the reinforcement bar 1 after the upsetting tool 20 has been removed therefrom and the relatively wide upset head 10 has been formed at the protruding end thereof. The coupling nut 6 can now be used in cooperation with the upset head 10 to reliably couple the steel reinforcement bar 1 projecting from the concrete structure 2 to an opposing steel reinforcement bar (not shown) whereby to provide continuous support between structure 2 and an adjacent concrete structure (also not shown). In this regard, a method for coupling the opposing reinforcement bars to one another by means of the upset head 10 of bar 1 is described in the aforementioned patent application Ser. No. 08/570,099.

Figure 7A:
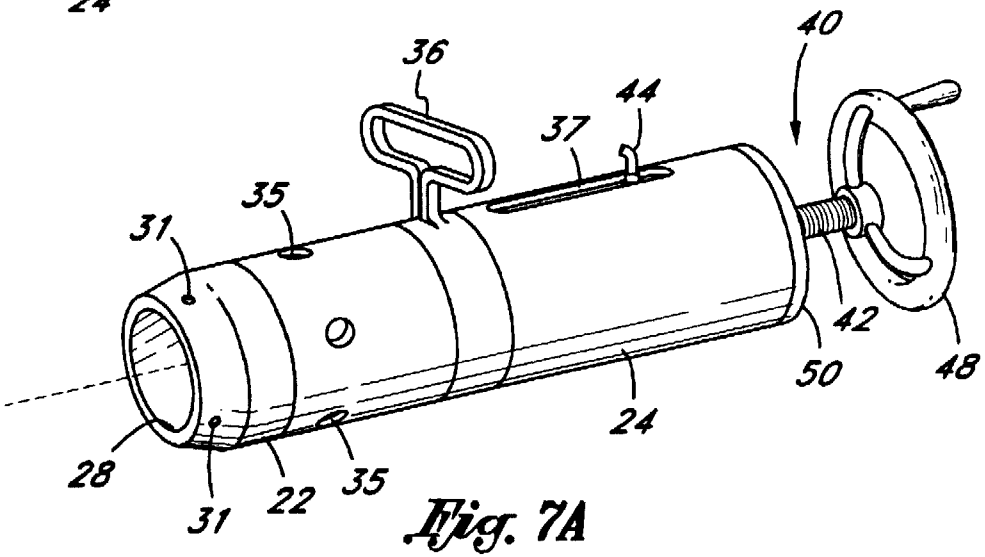
FIG. 7A shows the upsetting tool of FIG. 7 in the assembled configuration.

FIGS. 7–11 of the drawings show the portable, manually operated upsetting tool 20 that was referred to in FIGS. 1–6 for forming the upset head 10 at the protruding end of the steel reinforcement bar 1 so that the bar 1 can be reliable coupled to an opposing steel reinforcement bar to provide a continuous connection between a pair of adjacent concrete or similar structures. Referring initially to FIGS. 7 and 7A, the upsetting tool 20 is shown including the detachable interconnection of a mouth 22, a collar 24 and a housing 26. The mouth 22 is hollow with the front end thereof sloping inwardly towards an inlet opening 28 through which the protruding end of a steel reinforcement bar (e.g. 1 of FIGS. 1–6) is inserted after the protruding end has been heated as earlier described. The opposite rear end of the mouth 22 includes a set of peripheral screw threads 30 extending around the exterior thereof.

The collar 24 of upsetting tool 20 is a elongated hollow cylinder. Each of the front and rear ends of collar 24 has a set of peripheral screw threads 32 and 34 extending around the interior thereof. In the assembled relationship of FIG. 7A, the opposing sets of screw threads 30 and 32 around the rear end of mouth 22 and the front end of collar 24 are mated together. To facilitate the detachable connection of the mouth 22 to the collar 24 a set of tool holes 31 are evenly spaced from one another around the exterior of mouth 22 so that a tool (not shown) can impart a rotational force to the mouth 22 at the holes 31. A carrying handle 36 is affixed to the collar 34 at approximately the midpoint thereof to permit the upsetting tool 20 in the assembled configuration of FIG. 7A to be easily transported to and from the field and between job sites. An elongated slot 37 runs longitudinally across the top of the collar 24 between the handle 36 and the rear end of the collar for a purpose that will soon be described. A set of tool holes 35 are evenly spaced from one another around the front end of the collar 24 so as to receive a suitable tool and facilitate the connection of the collar 24 to the housing 26 as will also be described.

At the front end of the housing 26 of upsetting tool 20 is a plurality of (e.g. three) spring-controlled, rotatable jaws 38 that are enclosed by the hollow collar 24. The jaws 38 are preferably manufactured from forged steel or any other suitable hardened material. Each jaw 38 has a set of gripping teeth 39 formed at the inwardly facing side thereof. As will be explained in greater detail hereinafter, the rotatable jaws 38 are adapted to be rotated towards and away from one another and to slide axially between the front end of the collar 24 and the mouth 22 of tool 20 for grasping the projecting end of the reinforcement bar that has been heated and inserted through the inlet opening 28 of mouth 22.

At the rear end of the housing 26 opposite the rotatable jaws 38 is a cylindrical body 27. A fluid hose 44, which is coupled to the cylindrical body 27 of housing 26, communicates with a source of hydraulic fluid, such as an air operated or electrically powered pump, or the like (designated 8 in FIG. 4), to permit the upsetting tool 20 to generate sufficient hydraulic pressure to upset the pre-heated end of the steel reinforcement bar 1. In the assembled tool configuration of FIG. 7A, with the housing 26 located within and surrounded by the hollow collar 24, fluid hose 44 is received within and adapted to move reciprocally through the slot 37 of collar 24. By way of example, a single acting air operated pump that is suitable to supply hydraulic fluid to and drain hydraulic fluid from the body 27 of housing 26 via fluid hose 44 is EnerPac Model PAT-1102N.

A piston assembly 40 including a threaded piston rod 42 is received within and adapted to move through the hollow collar 24. At one end of the piston rod 42 is a piston head 46 (best shown in FIGS. 8–11) which is affixed (e.g. bolted) to the rear end of cylindrical body 27, and at the opposite end of rod 42 is a control wheel 48. A disk-like end cap 50 has a set of peripheral screw threads 52 extending therearound and a threaded opening for receiving the threaded piston rod 42 therethrough. In the assembled configuration of FIG. 7A, with the housing 26 surrounded by hollow collar 24, the end cap 50 is mated to the rear end of the collar 24 at the respective sets of screw threads 34 and 52, whereby to close the collar 24 to the atmosphere. As will be explained in greater detail hereinafter, a rotational force applied to the control wheel 48 of piston assembly 40 imparts a corresponding rotation to the piston rod 42 and an axial translation of the piston head 46 carried by rod 42 so as to cause the housing 26 to which the piston head 46 is affixed to slide through the collar 24 in a direction towards or away from the reinforcement bar 1 depending upon the direction in which the control wheel 48 is rotated.

Figure 8:
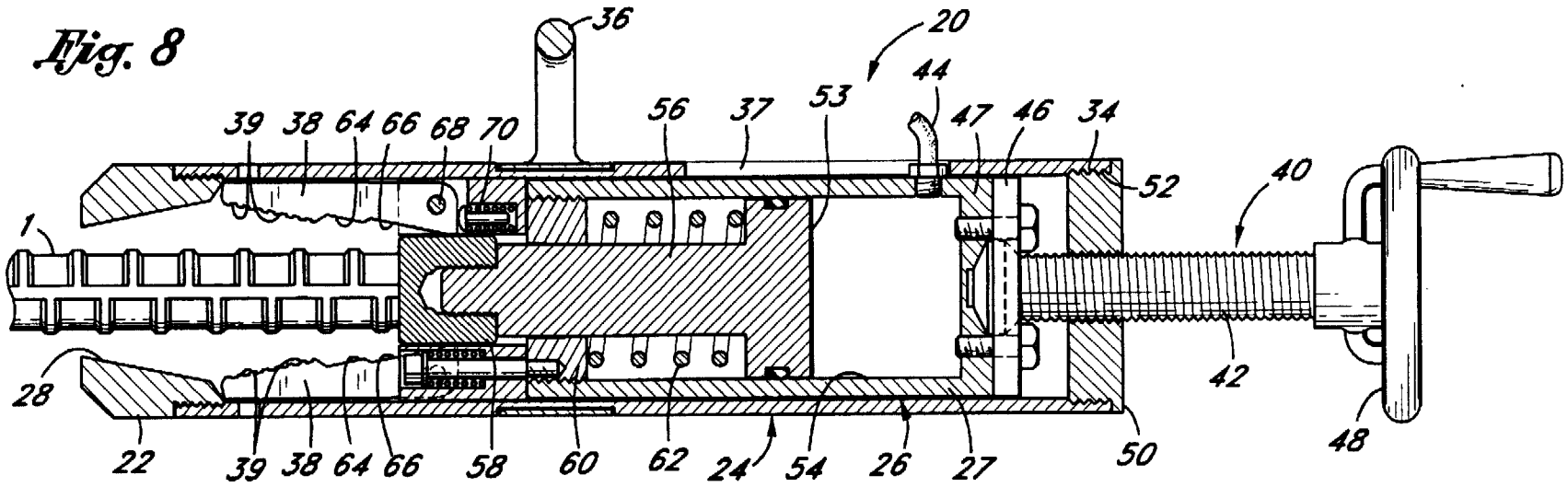
FIG. 8 shows a cross-section of the upsetting tool while at-rest.

FIG. 8 of the drawings shows the manually operated upsetting tool 20 after it has been carried into the field and positioned with respect to an embedded steel reinforcement bar (such as that represented by reference numeral 1 in FIG. 4) so that the pre-heated end of the reinforcement bar is received through the inlet opening 28 of mouth 22 to be surrounded by and spaced from the rotatable jaws 38 of the housing 26 which are located inside the hollow collar 24 behind the mouth 22. As it is shown in FIG. 8, the upsetting tool 20 is in an at-rest condition, such that no hydraulic fluid is being supplied through fluid hose 44 and no rotational force is being applied to the control wheel 48 of piston assembly 40 so that the piston head 46 carried by piston rod 42 and the housing 26 to which piston head 46 is affixed are stationary.

A hydraulic piston 53 is disposed within a cylinder 54 at the interior of the cylindrical body 27 of the housing 26. The hydraulic piston 53 is connected to an upsetting anvil 58 by means of a piston rod 56. Piston rod 56 extends through the front end 60 of the cylinder 54 so that the anvil 58 is located ahead of cylinder 54. Therefore, an axial displacement of hydraulic piston 53 is transferred to the anvil 58 which, in the at-rest condition of FIG. 8, lies against the pre-heated end of the incoming reinforcement bar 1 that is to be upset.

A coiled compression spring 62 is located between the front end 60 of cylinder 54 and the hydraulic piston 53 so as to surround piston rod 56 in coaxial alignment therewith. With the upsetting tool 20 in the at-rest condition, the compression spring 62 is also at rest so as to have an expanded shape. However, as will be disclosed when referring to FIG. 10, a forward movement of the hydraulic piston 53 through the cylinder 54 in a direction towards the front end 60 thereof will cause spring 62 to be compressed.

As previously described, in the at-rest condition of the upsetting tool 20, each of the rotatable jaws 38 of housing 26 is initially spaced from the pre-heated end of steel reinforcement bar 1 that has been received through the inlet opening 28 of sloping mouth 22. Each jaw 28 has a pair of serially aligned chamfers 64 and 66 extending along the inwardly facing side thereof behind the gripping teeth 39. As will soon be described, the jaws 38 are adapted to rotate towards one another to grip reinforcement bar 1 therebetween so that an upset head (designated 10 in FIG. 6) of bar 1 can be shaped within the chamfers 64 and 66. To this end, each rotatable jaw 38 is pivotably mounted on a pivot pin 68 so as to be rotated therearound in directions towards and away from the bar 1.

Figure 9:
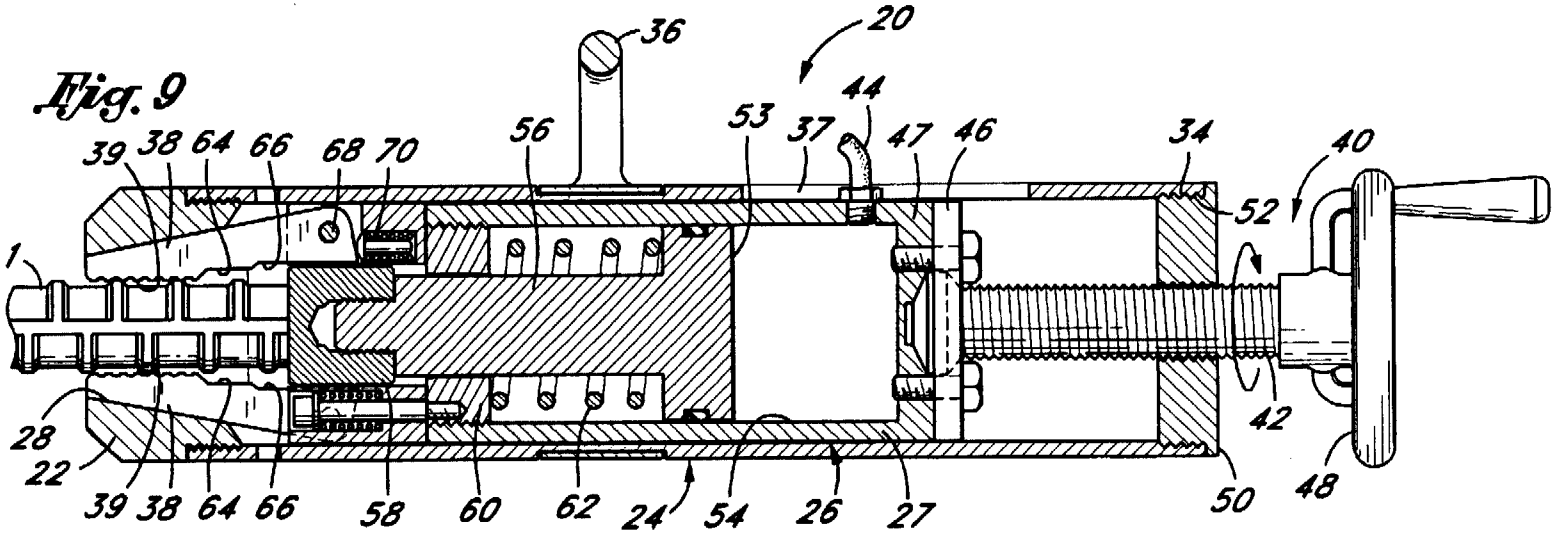
FIG. 9 shows a cross-section of the upsetting tool while gripping the protruding end of a reinforcement bar at which an upset head is to be formed.

Referring to FIG. 9 of the drawings, the operation of the upsetting tool 20 for upsetting the pre-heated end of the reinforcement bar 1 will now be described. First, with the reinforcement bar 1 located inwardly of the mouth 22 of tool 20, the workman rotates the control wheel 48 in a clockwise direction as represented by the reference arrow. The rotation of control wheel 48 causes the threaded piston rod 42 to similarly rotate and, at the same time, move axially through the threaded opening of end cap 50. The axial movement of piston rod 42 is transferred to piston head 46, whereby to push the housing 26 so that housing 26 slides through the collar 24 of upsetting tool 20 in a forward direction towards the reinforcement bar 1 that has been surrounded by the mouth 22. It may be appreciated that as the housing 26 slides through the collar 24, the fluid hose 44 that is coupled to the cylindrical body 27 of housing 26 will ride in the same forward direction along with housing 26 through the slot 37 formed in collar 24.

Accordingly, as the housing 26 of upsetting tool 20 is pushed through the collar 24, the jaws 38 of housing 26 will move towards and ride up the sloping inlet opening 28 of mouth 22. The sloping inlet opening 28 automatically urges the jaws 38 to rotate around their respective pivot pins 68 and thereby move towards an into clamping engagement with the pre-heated end of the reinforcement bar 1. At the same time, a biasing spring 70 that is associated with each jaw 38 will be slightly compressed as a result of the rotation of the jaws. With the teeth 39 of the articulating jaws 38 biting into the pre-heated protruding end of the reinforcement bar 1, the housing 26 is anchored against any further movement so as to no longer be capable of sliding in the forward direction through the collar 24.

Figure 10:
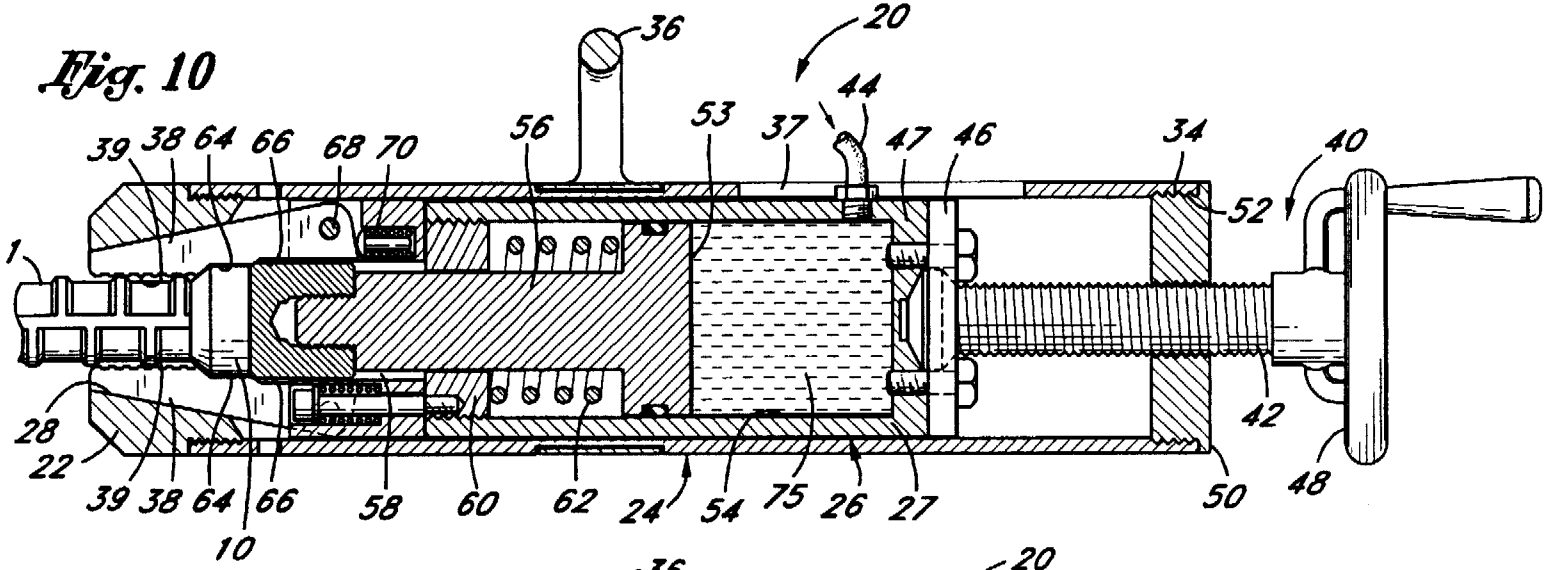
FIG. 10 shows a cross-section of the upsetting tool while compressing the reinforcement bar and shaping the upset head at the protruding end thereof.

FIG. 10 of the drawings shows hydraulic fluid (e.g. oil) 75 being supplied via fluid hose 44 to the cylinder 54 of housing 26 between the hydraulic piston 53 and the rear end 47 of the housing 46. By filling cylinder 54, hydraulic pressure will begin to build until the pressure is sufficient to force the hydraulic piston 53 to move through cylinder 54 in the forward direction towards the reinforcement bar 1. As the hydraulic piston 46 moves forwardly towards the bar, the compression spring 62, which is relaxed in the at-rest condition, is now compressed so as to store potential energy. Moreover, the forward movement of hydraulic piston 46 is transferred to the upsetting anvil 58 by way of the piston rod 56 therebetween. The forward moving upsetting anvil 58 is forced against the pre-heated end of reinforcement bar 1 which is clamped between the jaws 38 of housing 26.

Inasmuch as the reinforcement bar 1 is embedded in concrete and cannot be displaced in response to the impact force generated by anvil 58, the bar is compressed between the rotatable jaws 38 so as to cause metal at the pre-heated end of bar 1 to flow into the chamfers 64 and 66 along the inwardly facing sides of the jaws 38. The compressive force applied by anvil 58 against the pre-heated end of the reinforcement bar 1 is maintained for at least several seconds at approximately 5,000 psi until an upset head 10 is formed which conforms to the shape of the chamfers 64 and 66.

Figure 11:
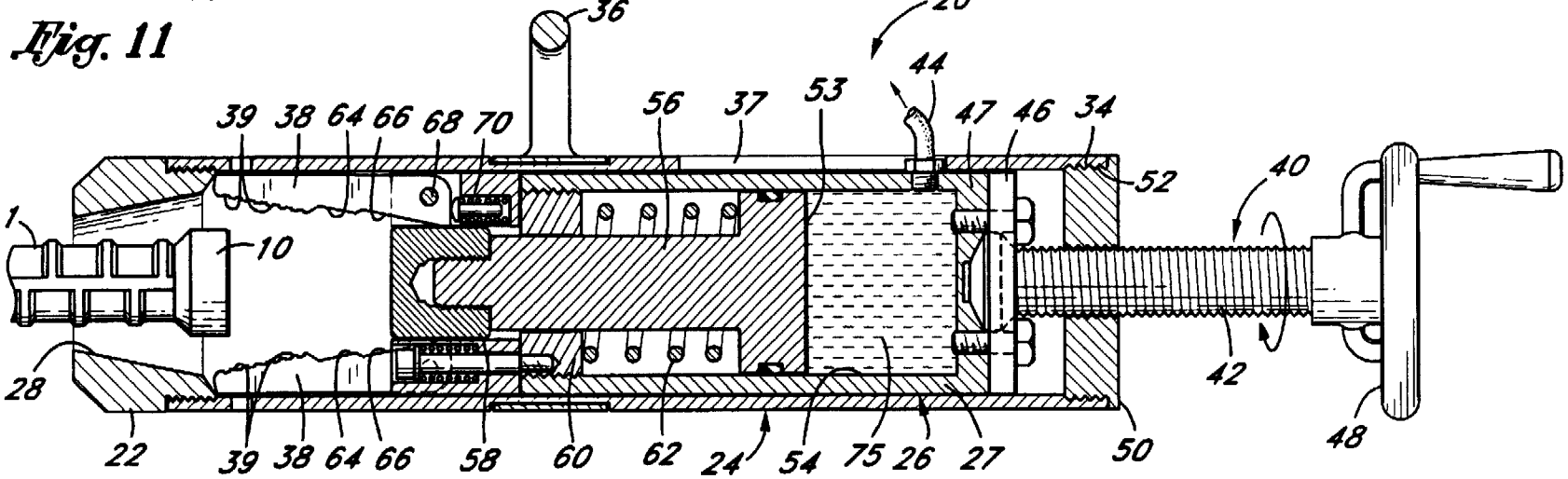
FIG. 11 shows a cross-section of the upsetting tool after the upset head has been formed and the reinforcement bar has been released so that the tool can be returned to the at-rest condition of FIG. 8.

Turning now to FIG. 11 of the drawings, once the upset head 10 has been formed on the reinforcement bar 1, hydraulic fluid 75 is no longer supplied from the pump 8 to the cylinder 54 of housing 26. At this time, the compression spring 62 is able to overcome the pressure build up in cylinder 54, such that spring 62, which was previously compressed by means of the hydraulic piston 53 moving in a forward direction towards the reinforcement bar 1, now expands towards its at-rest shape. The potential energy stored by the spring 62 is released to cause the hydraulic piston 53 to be driven in a rearward direction through the cylinder 54 of housing 26. Accordingly, the hydraulic fluid 75 which has filled the cylinder 54 is expulsed therefrom to be returned to pump 8 via fluid hose 44. Moreover, the upsetting anvil 58, which is connected to hydraulic piston 53 by piston rod 56, is pulled away from the upset head 10 of reinforcement bar 1.

The workman now rotates the control wheel 48 of the piston assembly 40 in a counter-clockwise direction to impart a corresponding rotation to the threaded piston rod 42. The piston head 46, which is connected to piston rod 42, undergoes a corresponding rotation and an axial displacement so as to pull the housing 26 away from the upset end of reinforcement bar 1, whereby housing 26 slides rearwardly along the collar 24. Hence, the jaws 38 at the front end of the housing 26 will slide down the ramped inlet opening 28 of the mouth 22 and out of clamping engagement with the reinforcement bar 1. That is, the springs 70 that are associated with respective jaws 38 expand so as to urge the jaws to rotate away from the reinforcement bar 1 and return to their at-rest position of FIG. 8. Of course, as the housing 26 slides rearwardly relative to the collar 24, the fluid hose 44 will move along with the housing so as to ride through the elongated slot 37 in the collar 24 which surrounds housing 26.

The operator can now withdraw the upsetting tool 20 from the reinforcement bar 1 with the upset head 10 which is formed thereon suitable for coupling to an opposing reinforcement bar in the manner described by patent application Ser. No. 08/570,099. The operator may then use handle 36 to carry the upsetting tool 20 to a protruding upstand of a different reinforcement bar to form an upset head thereon in the same manner as has been disclosed above. In the alternative, a conventional gripping tool (not shown) can be manipulated by the operator to engage the mouth 22 at the tool holes 31 thereof (best shown in FIG. 7) in order to rotate the threaded mouth 22 out of engagement with the threaded collar 24 and thereby facilitate the cleaning and/or repair of the upsetting tool 20.

It will be apparent that while a preferred embodiment of the invention has been shown and described, various modifications and changes may be made without departing from the true spirit and scope of the invention. For example, although a reinforcement bar has been shown and described as being imbedded within a concrete or similar structure, it is to be understood that the present invention is also applicable to upsetting reinforcement bars prior to their being located in the field or embedded in any structure.

Having thus set forth the preferred embodiment, what is claimed is:

1. An upsetting tool to upset a pre-heated end of a reinforcement bar, said upsetting tool comprising:

a hollow collar;

an open mouth connected to said hollow collar to receive the pre-heated end of the reinforcement bar therewithin;

a housing having first and opposite ends and being surrounded by and slidable in first and opposite directions through said hollow collar;

gripping means located at the first and of said housing and slidable therewith through said hollow collar to releasably grasp the pre-heated end of the reinforcement bar received within said open mouth to prevent the displacement of the reinforcement bar;

upsetting means axially aligned with the pre-heated end of the reinforcement bar and adapted to upset the pre-heated end;

a cylinder located at the opposite end of said housing and slidable therewith through said hollow collar;

an elongated rod attached to said housing within said hollow collar, said elongated rod extending outwardly of said collar so as to be moved in said first and opposite directions for causing said housing to correspondingly slide in said first and opposite directions through said collar;

a hydraulic piston located within and movable reciprocally through said cylinder, said hydraulic piston interconnected with said upsetting means; and hydraulic fluid source means communicating with said cylinder to supply hydraulic fluid to said cylinder to generate a hydraulic pressure therein to drive said hydraulic piston in said first direction through said cylinder for causing said upsetting means to move towards the pre-heated end of the reinforcement bar to compress the pre-heated end and thereby form an upset head, said hydraulic piston moving in said opposite direction through said cylinder for causing said hydraulic fluid to be removed from said cylinder and said upsetting means to move away from said upset head.

2. The upsetting tool recited in claim 1, further comprising a piston rod interconnected between said hydraulic piston and said upsetting means so that movements of said hydraulic piston in said first and opposite directions through said cylinder are imparted to said upsetting means to cause said upsetting means to correspondingly move towards and away from the reinforcement bar.

3. The upsetting tool recited in claim 2, further comprising spring means surrounding said piston rod so as to be coaxially aligned therewith, said spring means being compressed when said hydraulic piston moves in said first direction through said cylinder and said spring means expanding after the upset head is formed to drive said hydraulic piston in said opposite direction through said cylinder.

4. The upsetting tool recited in claim 1, wherein said gripping means includes a plurality of jaws that surround the reinforcement bar and are adapted to move towards and into clamping engagement with the pre-heated end of the reinforcement bar to prevent the displacement of the reinforcement bar, said plurality of jaws also adapted to move away from the reinforcement bar to release the reinforcement bar after said upset head is formed.

5. The upsetting tool recited in claim 4, wherein said open mouth to receive the pre-heated end of the reinforcement bar has a sloping wall and said plurality of jaws being disposed in axial alignment with said sloping wall, said plurality of jaws moving towards and sliding over said sloping wall for causing said jaws to move into clamping engagement with the pre-heated end of the reinforcement bar.

6. The upsetting tool recited in claim 4, further comprising at least one chamfer formed in at least one of said plurality of jaws, said upset head being shaped within said at least one chamfer when said jaws are moved into clamping engagement with the pre-heated end of the reinforcement bar and said upsetting means is moved towards the pre-heated end to compress the pre-heated end and thereby form said upset head.

7. The upsetting tool recited in claim 1, further comprising a fluid hose extending between said hydraulic fluid source means and the cylinder of said housing, said hollow collar having a longitudinally extending slot formed therein, and said fluid hose riding through said slot when said housing slides in said first and opposite directions through said hollow collar.

8. The upsetting tool recited in claim 1, further comprising a rotatable control wheel disposed outwardly of said hollow collar, said elongated rod connected between said control wheel and said housing within said collar for causing said housing to slide in one of said first and opposite directions through said collar depending upon the direction in which said control wheel is rotated.

9. The upsetting tool recited in claim 8, further comprising a piston head connected to said cylinder of said housing, said elongated rod extending from said rotatable control wheel to said piston head so that a rotation of said control wheel is translated into an axial displacement of said housing through said collar.

10. The upsetting tool recited in claim 8, wherein said rotatable control wheel is disposed at a manually accessible location outwardly of said hollow collar so that said control wheel is rotated in response to a manually applied force for causing an axial displacement of said housing through said collar.

11. The upsetting tool recited in claim 8, wherein said collar includes an end cap having a screw threaded hole, said elongated rod having screw threads formed therealong and being received through the screw threaded hole of said end cap so that a rotation of said rotatable control wheel is translated into an axial displacement of said housing through said collar.

12. The upsetting tool recited in claim 1, wherein said gripping means is a plurality of jaws that are carried by and moveable with said housing, said plurality of jaws adopted to rotate towards and into clamping engagement with the pre-heated end of the reinforcement bar and said plurality of jaws also adapted to rotate away from the pre-heated end to release the reinforcement bar after the bar is upset.

* * * * *